US006206362B1

(12) United States Patent
Tan et al.

(10) Patent No.: US 6,206,362 B1
(45) Date of Patent: Mar. 27, 2001

(54) MEDIA STACK STATUS INDICATOR

(75) Inventors: Teck Cheng Tan; Cher Lek Toh; Seng San Koh, all of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/387,191

(22) Filed: Aug. 31, 1999

(51) Int. Cl.[7] ..... B65H 5/26; B65H 1/00
(52) U.S. Cl. ..... 271/145
(58) Field of Search ..... 271/145, 258.01, 271/258.04, 258.05; 399/393; 400/624

(56) References Cited

U.S. PATENT DOCUMENTS 5,028,041 * 7/1991 Kobayashi ..... 271/9 X
5,236,348 8/1993 Fetherolf et al. .
5,897,112 * 4/1999 Kwag ..... 271/38 X

FOREIGN PATENT DOCUMENTS 59-31234 * 2/1984 (JP) .
1-236123 * 9/1984 (JP) .
1-226648 * 9/1989 (JP) .
2-62343 * 3/1990 (JP) .
4-159945 * 6/1992 (JP) .
6-1478 * 1/1994 (JP) .

* cited by examiner

*Primary Examiner*—Christopher P. Ellis
*Assistant Examiner*—Kenneth W Bower

(57) ABSTRACT

An indicator for continuously indicating the status of a media stack in a media tray is disclosed. This indicator functions independently of a media stack support in a printer. The indicator includes an indicator lever and a probe member. The indicator lever is pivotably mounted and can be tilted between two predetermined extreme positions. The probe member has a shaft which is also pivotably mounted. An engaging arm extends from the shaft. In operation, the shaft is tilted according to the status of the media stack in the media tray. As the shaft is tilted, the engaging arm engages the indicator lever, tilting the indicator lever to a position between the two extreme positions to indicate the status of the media stack.

8 Claims, 3 Drawing Sheets

MEDIA STACK STATUS INDICATOR

FIELD OF INVENTION

This invention relates to an apparatus for indicating media stack height or status in a media tray. More particularly, the invention relates to an apparatus for indicating media stack status by obtaining the status directly from the media stack.

BACKGROUND

Office equipment such as photocopiers, laser printers, ink jet printers and other imprinting mechanisms today incorporate an ability to store and supply sheet media from a stack. This stack is typically stored within the covers of the equipment or in a covered tray installed in the equipment. Such storing of a media stack not only enhances the overall aesthetic appeal of the equipment, but it also reduces exposure of mechanisms in the equipment to dust and foreign materials. The covered media stack is however invisible to a user. As such a user is unable to tell the status of the media stack without having to remove the covers. In many of the equipment, the only indication the user receives of a media-out status is a signal when the media supply has actually been exhausted. Normally, the signal is issued during a printing or copying job and requires the job to be interrupted to re-supply the media stack. It is preferable that a continuous indication be given of the current status of the media stack so that the user is able to interrupt the copying or print job at a convenient point to replenish the stack.

There are many existing mechanisms for indicating the status of a media stack in a media tray. These mechanisms usually rely on the position of a stack support for detecting and indicating the media stack status. One such mechanism is described in the U.S. Pat. No. 5,236,348. The stack support is positioned within a media tray. One end of the stack support is pivotably mounted to the tray housing. The other free end of the stack support is thus moveable about this pivot between a tray-empty position and a tray-full position. A spring support attached to a base of the stack support biases the free end of the stack support towards the tray-empty position. When a full stack of media is loaded into the tray, the stack support is pushed to a tray-full position. As media in the tray is consumed, the stack support is pushed towards the tray-empty position. A pivotably mounted indicator lever positioned within the tray cooperates with the stack support to indicate the media stack status. A first portion of the lever is in contact with a surface of the stack support such that as the stack support moves between the tray-empty and tray-full positions, a second portion of the indicator lever is moved accordingly to reflect the media stack status.

Though such a simple and cost-effective mechanism works well, it is heavily reliant on the peculiar operation of the stack support for deriving the media stack status. Not all equipment will employ such a stack support design. In such equipment, the mechanism described will not be suitable for the purpose of indicating a media stack status. A new mechanism will be required. One such equipment which requires the new mechanism is one which employs a stack support which moves up and down during each pick cycle. This stack support design is necessary to allow the equipment to use a single motor for driving a pick roller as well as a media feed. During a pick cycle, the stack support is moved towards the pick roller to allow a top sheet on the media stack to be drawn out of the tray roller into an infeed zone. Once the sheet is engaged by the pick roller, the stack support is moved away from the pick roller so that no new sheets are picked during a subsequent media feed cycle, where the picked sheet is transported to a print zone.

From the foregoing, the prior art has a need for a media stack status indicator which derives information for indicating the media stack status independently of a stack support.

SUMMARY

In accordance with a preferred embodiment of the present invention, a media stack status indicator includes an indicator lever and a probe member. The indicator lever is pivotably mounted on a first pivoting axis in a media container for holding a media stack. This indicator lever is biased to a first predetermined position and can be tilted between the first predetermined position and a second predetermined position. The probe member has a shaft which is pivotably mounted on a second pivoting axis in the media container. An engaging arm extends from the shaft. In operation, the shaft is tilted to detect the status of a media stack in the media container. As the shaft is tilted, the engaging arm engages the indicator lever to tilt the indicator lever. The indicator lever is therefore able to indicate the status of the media stack in the media container.

The media stack status indicator preferably includes a lock member which is biased to tilt the probe member to a retracted position under a lifted cover of the media container. When the cover is placed over a tray of the media container, the lock member is released to allow the probe member to tilt about the second pivoting axis.

BRIEF DESCRIPTION OF DRAWINGS

The invention will be better understood with reference to the following drawings, in which.

DETAILED DESCRIPTION OF THE PREFERRED EMBODIMENT

Figure 1:
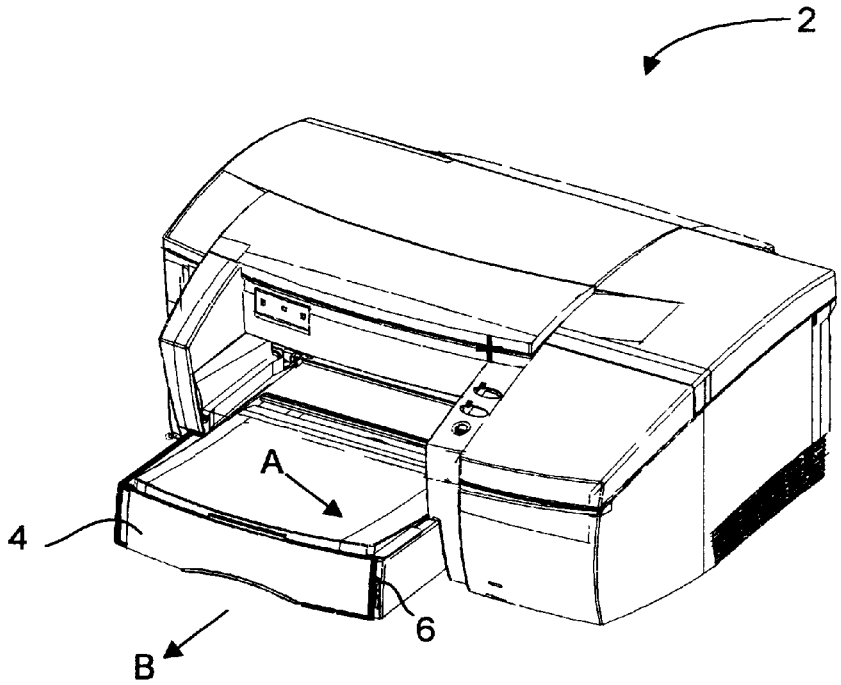
FIG. 1 is an isometric view of an ink jet printer with an installed media tray. A media stack status indicator according to the present invention is housed in the media tray. A tip of the indicator is exposed for viewing the media stack status.

Hereafter, a preferred embodiment of the present invention will be described in the context of an ink jet printer having a removable media tray. However, it is to be understood that the invention is usable with any imprinting or sheet handling equipment where a sheet supply indication is desired. FIG. 1 is an isometric view of an ink jet printer 2 with an installed media tray 4. In order to replace a stack of media within the media tray 4, a user grasps the lower portion of the media tray 4 and pulls it in the direction of Arrow B. The withdrawal of the media tray 4 exposes the media stack and enables its replenishment. A media stack status indicator (hidden from view) positioned within the media tray 4 indicates the height or status of the media stack in the media tray 4. An exposed tip 6 of the media stack status indicator gives a user a continuous visual indication of the media stack status height or status.

Figure 2:
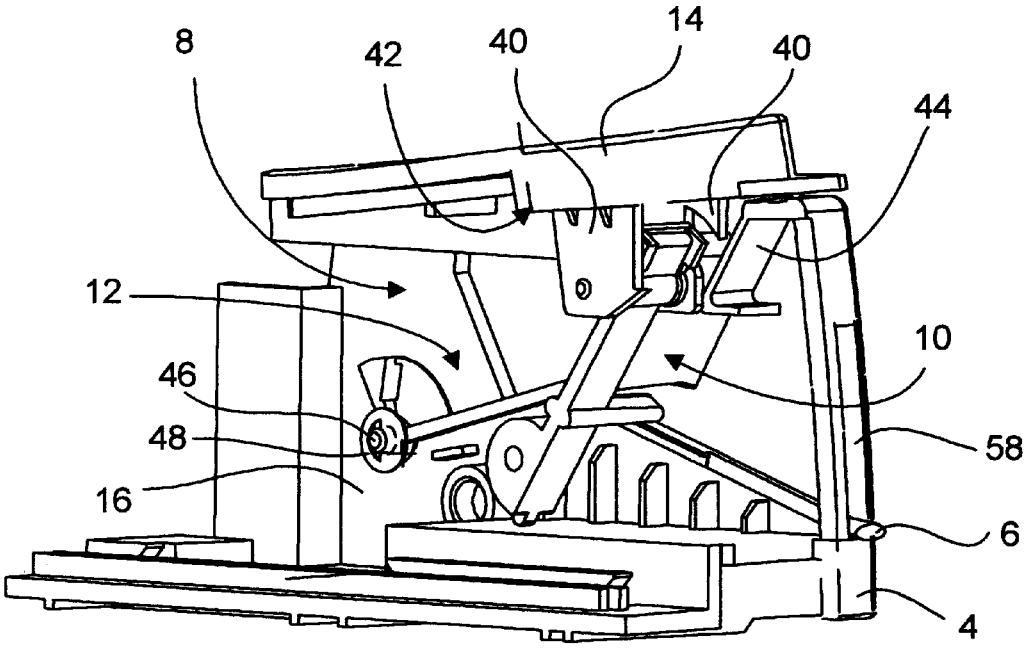
FIG. 2 is an exposed isometric view of the media stack status indicator in FIG. 1 as seen in the direction according to an arrow A. The indicator has a probe member and an indicator lever.

FIG. 2 is an exposed isometric view of the media stack status indicator 8 as seen in the direction according to an arrow A in FIG. 1. The media stack status indicator 8 has a probe member 10 and an indicator lever 12. The probe member 10 is shown attached to a cover 14 for the media tray 4. The indicator lever 12 is shown attached to the media tray 4. When the cover 14 is removed from the tray 4, the probe member 10 is retracted into an unused position of the probe member 10 under the cover 14. When the cover 14 is placed over the tray 4, the probe member 10 is released to allow it to cooperate with the indicator lever 12 in the tray 4 to indicate the media stack status. The indicator lever 12 is preferably pivotably mounted on a side wall 16 of the tray 4 and is biased upwards to a tray-full position when the cover 14 is removed. In operation, the cover 14 is placed over the tray 4. In this position of the cover 14, the probe member 10 is allowed to fall to engage the indicator lever 12. The probe member 10 will come to rest on top of the media stack in the tray 4. In this position of the probe member 10, the indicator lever 12 will indicate the media stack status accordingly.

Figure 3A:
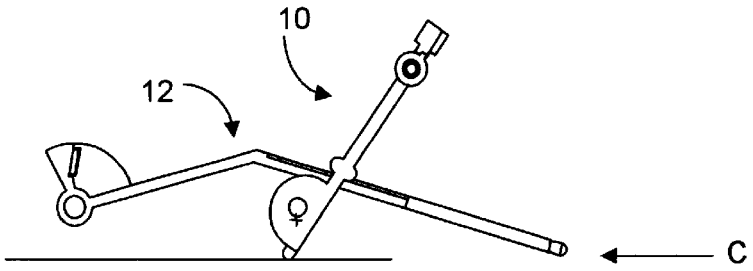
FIG. 3A is a side view of the media stack status indicator of FIG. 2 shown in a tray-empty position.
Figure 3B:
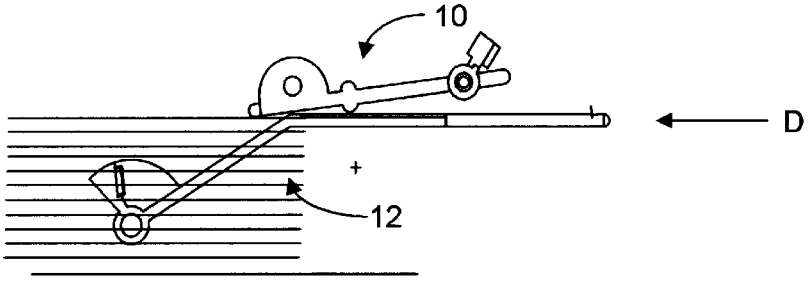
FIG. 3B is a side view of the media stack status indicator of FIG. 2 shown in a tray-full position.

FIG. 3A is a view of the media stack status indicator in a tray-empty position. When the media tray 4 is empty, the probe member 10 will push the indicator lever 12 to its lowest point to indicate a tray-empty status as indicated by arrow C. FIG. 3B is a view of the media stack status indicator 8 in a tray-full position. When the tray 4 is fully replenished with media, the top of the stack will stop the probe member 10 in its downward fall. The stopping of the probe member 10 will prevent the biased indicator lever from being pushed further downwards. In this position of the probe member 10, the indicator arm is allowed to indicate a tray-full status as indicated by arrow D.

Figure 4:
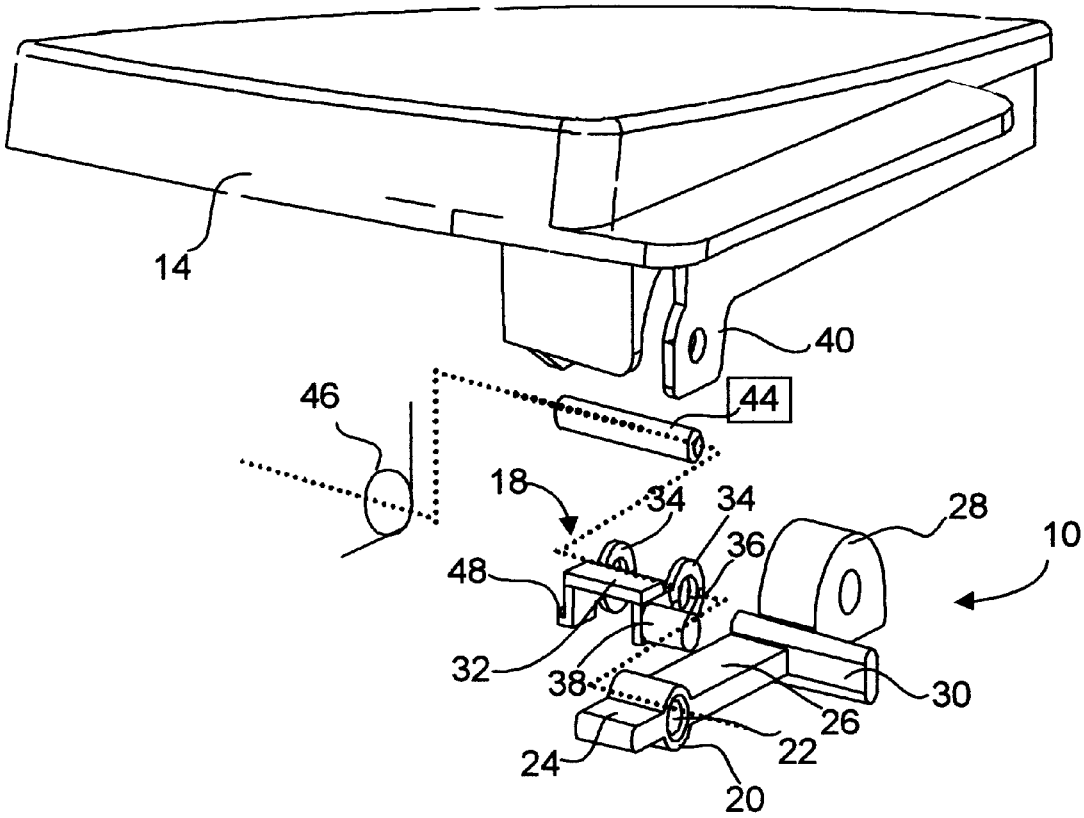
FIG. 4 is an exploded view of the media stack indicator of FIG. 2.
Figure 4:
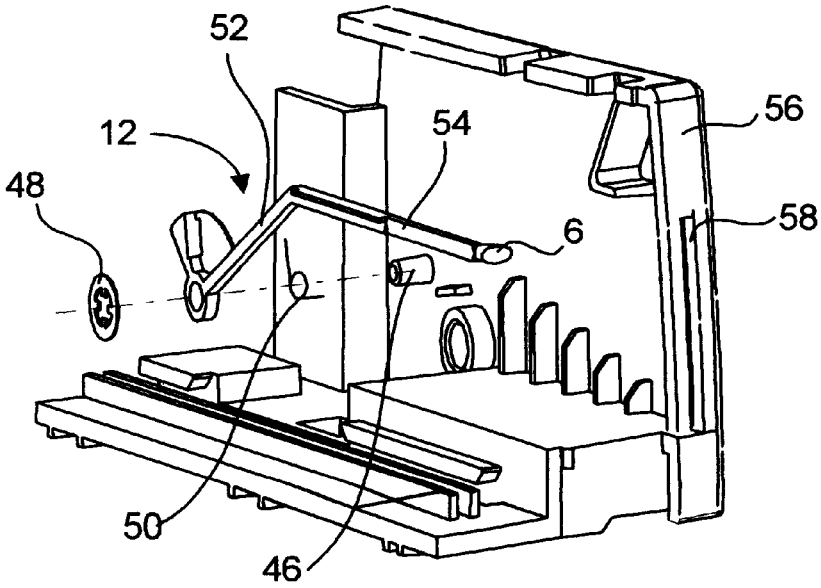

FIG. 4 is an exploded view of the media stack status indicator 8. As described earlier, the indicator 8 includes a probe member 10 and an indicator lever. Additionally, the indicator 8 includes a lock member 18 or retracting the probe member 10. The probe member 10, indicator lever 12 and lock member 18 are preferably of plastic, such as ABS plastic. The probe member has a mounting portion 20 having a through aperture 22 for pivot mounting. On one side of the mounting portion 20 is a locking end 24. On the other side of the mounting portion is a shaft 26 ending at an enlarged head 28. Extending laterally from one side of the shaft 26 is an engaging arm 30.

Figure 5A:
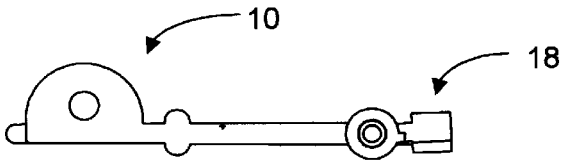
FIG. 5A is a side view of the probe member in FIG. 2 shown retracted.

The lock member 18 has a locking plate which is bifurcated at one end to define two mounting portions 34. The mounting portions 34 have apertures 36 which are in alignment with each other. Extending laterally from one side f the other end of the locking plate 32 is a locking arm 38. To assemble the lock member 18 and the probe member 10 to the cover 14, the lock member 18 is placed over the locking end 24 of the probe member 10 such that the apertures 36 of the lock member 18 align with the aperture 22 on the probe member 10. This lock and probe members 10,18 are then pivotably mounted to supports 40 depending from an underside 42 of the cover 14. A pin 44, preferably of steel, is inserted through the apertures 22, 36 and press-fitted to corresponding apertures on the supports 40 to effect this pivot mounting. A torsion spring 46 attaches at one end to a ledge 48 of the lock member 18 and at the other end to a tab on one of the supports 40 to bias the lock member 18 away from the underside 42 of the cover 14. The locking plate of the lock member 18 impinges upon the locking end 24 of the probe member to tilt the shaft 26 of the probe member 10 towards the underside 42 of the cover 14. The probe member 10 stays in this retracted position when the cover 14 is removed from the tray 4. FIG. 5A is a side view of the lock member 18 biased to push the probe member to the retracted position.

Figure 5B:
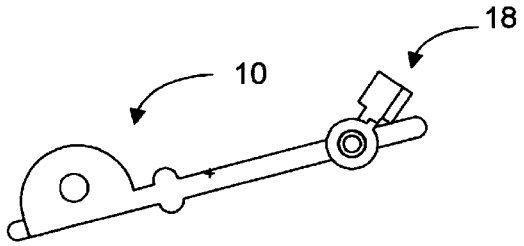
FIG. 5B is a side view of the probe member in FIG. 2, shown released for operation to indicate the status of a media stack.

When the cover 14 is placed over the tray 4, an inclined tab 44 projecting from the side wall 16 of the tray 4 comes into contact with the locking arm 24 of the lock member 18. This action causes the lock member 18 to be lifted towards the underside 42 of the cover 14. This tilting of the lock member 18 disengages the locking plate 32 from the locking end 24 of the probe member 10. The probe member 10 is thus free to tilt about its pivot axis. FIG. 5B is a side view of the lock member 18 shown held by the inclined tab 44 to allow the probe member to freely tilt about its pivot axis.

The indicator lever 12 is pivotably mounted to a cantilevered pin 46 integral with the side wall 16 of the cover 14. This mounting allows the indicator lever 12 to tilt about the cantilevered pin 46 between a tray-empty position and a tray-full position of the indicator lever 12. An external circular nut 48 is placed over a free end of the cantilevered pin 46 to lock the indicator lever 12 in place. Another torsion spring 50 with one end attached to the indicator lever 12 and the other end attached to a tab on the side wall 16, biases the indicator lever 12 to the tray-full position. The indicator lever 12 is in this tray-full position when the cover 14 is removed from the tray 4.

The indicator lever 12 has a first portion 52 and a second portion 54. The two portions 52, 54 are inclined at an angle to each other to allow the indicator lever's tray-empty and tray-full positions to substantially correspond to no media and a full stack of media in the tray 4 respectively. Such a bi-portioned indicator lever 12 allows the indication of the status over the entire range of media stack in the tray with the tip 6 of the indicator lever 12 held substantially in a same vertical plane. Such a design of the indicator lever 12 allows the tip 6 to substantially follow the contour of a side wall 56 of the tray 4. In operation, as the probe member 10 tilts downwards, the engaging arm 30 on the probe member 10 engages the second portion 54 of the indicator lever 12 to push the indicator level 12 down with it. The mass of the probe member 10 should be sufficient to overcome the force exerted on the indicator lever 12 by the torsion spring 50. A tip 6 of the indicator lever 12 protrudes a window 58 in the side wall 56 to give a continuous visual indication of the media stack status from outside the tray.

We claim:

1. A media stack status indicator mounted in a media container for indicating a status of a media stack in the media container, the media stack status indicator comprising:

an indicator lever which is pivotably mounted along a first pivoting axis in the media container, the indicator lever being biased to a first predetermined position and tiltable between the first predetermined position and a second predetermined position; and a probe member including:

a shaft pivotably mounted along a second pivoting axis in the media container which tilts in response to the status of the media stack; and an engaging arm extending from the shaft;

wherein the shaft when tilted allows the engaging arm to engage the indicator lever to tilt the indicator lever between its first and second predetermined positions to indicate the media stack status.

2. The media stack status indicator according to claim 1, wherein the shaft is gravitationally biased to tilt about the second pivoting axis.

3. The media stack status indicator according to claim 1, wherein the shaft when tilted rests on the media stack to allow the indicator lever to indicate the status of the media stack.

4. The media stack status indicator according to claim 1, wherein the indicator lever has a first portion and a second portion which are inclined at an obtuse angle with each other, the first portion being pivotably mounted to allow the second portion to be tilted by the probe member to substantially indicate the status of the media stack throughout an empty to a full position of the media stack.

5. The media stack status indicator according to claim 1, wherein the media stack status indicator continuously indicates the status of the media stack.

6. The media stack status indicator according to claim 1, wherein the media container has a cover and a tray and the indicator lever is mounted in the tray and the probe member is mounted on an undersurface of the cover.

7. The media stack status indicator according to claim 6, further comprising:

a lock member 18 biased to tilt the probe member to a retracted position under the cover and to be releasable to allow the probe member to tilt about the second pivoting axis.

8. The media stack status indicator according to claim 7, wherein the lock member 18 has a locking arm which cooperates with a tab on the tray to allow the lock member 18 to be released when the cover is placed over the tray.

* * * * *